US005102058A

United States Patent [19]

Mericle et al.

[11] Patent Number: 5,102,058

[45] Date of Patent: Apr. 7, 1992

[54] CHEEK PLATE FOR MILLING APPARATUS

[75] Inventors: Craig Mericle, Sergeant Bluff, Iowa; Ron Bocian, South Sioux City, Nebr.; Daryl Sybesma, Clear Lake, Iowa

[73] Assignee: Ag Processing Inc., a cooperative, Omaha, Nebr.

[21] Appl. No.: 519,771

[22] Filed: May 7, 1990

[51] Int. Cl.[5] ..... B02C 4/28

[52] U.S. Cl. ..... 241/226; 241/57

[58] Field of Search ..... 241/226, 62, 227, 57, 241/224

[56] References Cited

U.S. PATENT DOCUMENTS 3,332,630 7/1967 Verdier ..... 241/226 X

FOREIGN PATENT DOCUMENTS 960284 4/1950 France ..... 241/226

715509 9/1954 United Kingdom ..... 241/226

782642 9/1957 United Kingdom ..... 241/226

*Primary Examiner*—Mark Rosenbaum

*Attorney, Agent, or Firm*—Kent A. Herink; Brian J. Laurenzo

[57] ABSTRACT

A cheek plate for preventing material from passing unmilled around the ends of a pair of milling rollers of a milling apparatus. The cheek plate is of a generally cuneiform shape having a pair of concave edges and is mounted on an end plate of the milling apparatus a short distance from the rollers. Compressed air supplied centrally of the cheek plate is distributed for release to the atmosphere along the concave edge of the cheek plate.

4 Claims, 2 Drawing Sheets

CHEEK PLATE FOR MILLING APPARATUS

BACKGROUND OF THE INVENTION

The invention relates generally to milling apparatus and, more specifically, to a cheek plate which uses compressed air to direct material being milled between a pair of milling rollers.

Conventional milling apparatus use a pair of milling rollers positioned closely adjacent and rotated in opposite directions so that material to be milled passes generally between the rollers. The position of the rollers is relatively moveable to permit adjustment of the milling distance between the rollers to affect the characteristics of the milled product and to accommodate a diversity of materials.

In conventional milling apparatus, cheek plates are used at either end of the pair of rollers to prevent material from flowing or passing over the ends of the rollers and thereby not being milled. Known cheek plates must be carefully positioned closely adjacent or in sliding contact engagement with the pair of rollers. Unless the cheek plates are appropriately positioned, material being milled will become lodged between the cheek plates and the rollers, causing excessive wear to the cheek plates and loss of efficiency of the milling operation, or may work underneath and past the cheek plates where it will fall unmilled into otherwise milled material below. Unmilled material will detract from the uniformity of the desired milled material and may cause problems in certain of the after-processing uses of the milled material.

To avoid such problems, it is necessary to monitor and maintain the position of the cheek plates flush with the rollers. During operation of the milling apparatus, the conventional cheek plates wear and abrade with the result that a gap may exist between the rollers and the cheek plate which will enlarge and eventually allow the material to pass unmilled over the ends of the rollers. As the cheek plates wear, accordingly, they must be moved regularly to be maintained in flush contact with the rollers. After some period of time, the cheek plates will have worn to the point where they must be replaced.

There is a need, therefore, for a cheek plate which will direct material between the rollers and prevent it from passing unmilled over the ends of the rollers and which is not in need of constant adjustment and will not require frequent replacement.

SUMMARY OF THE INVENTION

The present invention is a cheek plate for a milling apparatus including a pair of horizontal rollers situated closely adjacent to each other. The cheek plate includes a doubly concave arrow head-shaped body member, having a base plate and an overlying face plate. The radius of curvature of the body member corresponds to the radius of the rollers so that the body member, when situated at either end and atop of the rollers, will be closely adjacent thereto along the entire end portion of the rollers where material being milled will be found.

A plurality of channels are formed in the body member. Compressed air introduced centrally of the body member into the channels through the base plate flows to the two concave edges of the body member. An air outlet along each of the concave edges directs the compressed air out of the body member and onto the rollers. The compressed air will act to keep the milling material from moving under the cheek plate, thereby preventing lodging of the material between the cheek plate and the rollers and passage of unmilled material around the ends of the rollers.

DETAILED DESCRIPTION OF A PREFERRED EMBODIMENT

Figure 1:
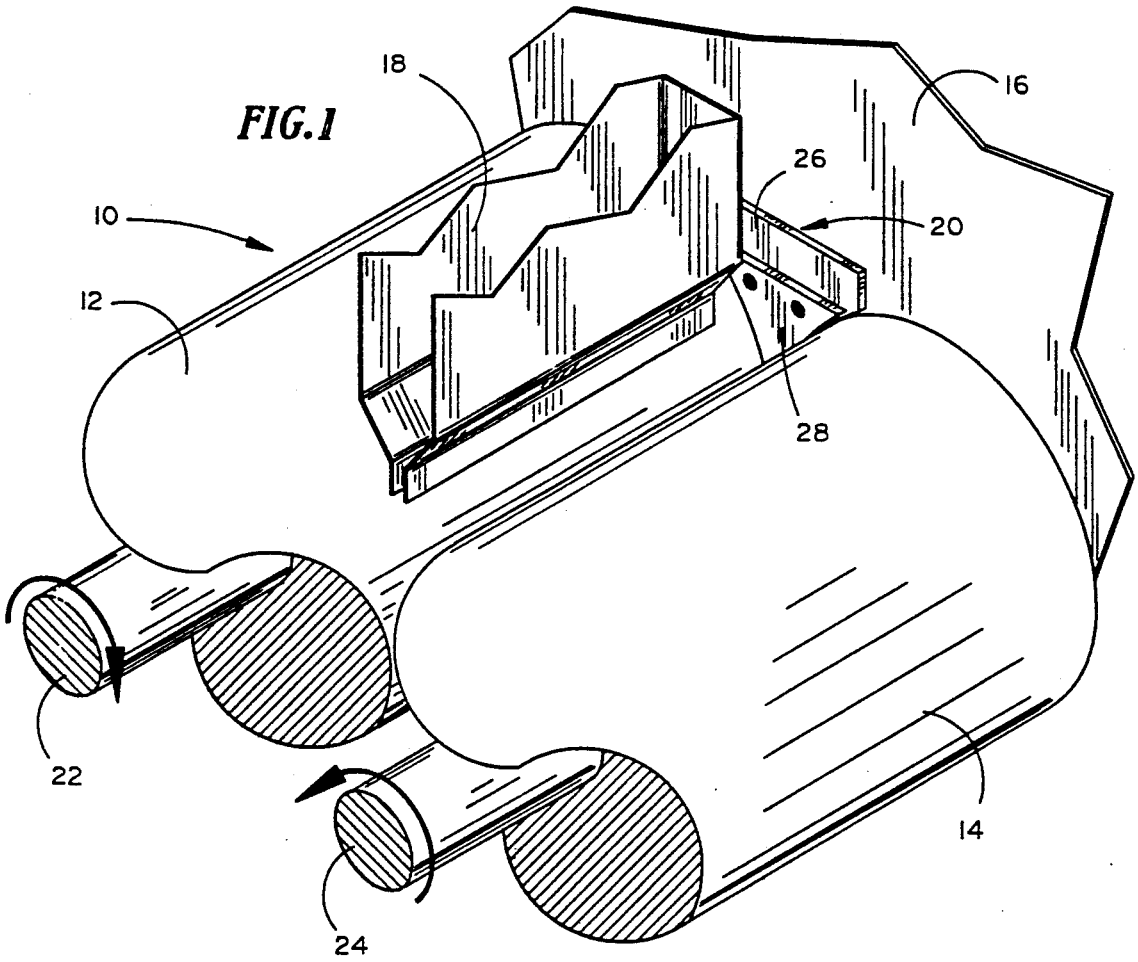
FIG. 1 is a perspective view of a portion of a milling apparatus showing a cheek plate of the present invention mounted at the end of a pair of milling rollers.

Referring to FIG. 1, there is depicted, generally at 10, a portion of a conventional milling apparatus, including a first milling roller 12, a second milling roller 14, an end wall 16, a material feed chute 18, and a cheek plate 20. The rollers 12 and 14 are rotated during the milling operation about parallel horizontal shafts 22 and 24 such that they feed from the top toward each other, that is, in the directions of the arrows shown in FIG. 1. Material to be milled in the apparatus 10 is fed atop the rollers 12 and 14 from chute 18, compressed and milled between the rollers 12 and 14, and falls into a receiving section (not shown). The rollers 12 and 14 rotate adjacent the fixed end plate 16 of the milling apparatus 10. Material being milled tends to migrate toward the end plate 16 where, if unimpeded, it can pass under the rollers 12 and 14 near the end plate 16 and into the receiving section without being milled. The cheek plate 20 of the present invention acts to prevent the material from escaping past the rollers 12 and 14 as will be described below.

Figure 2:
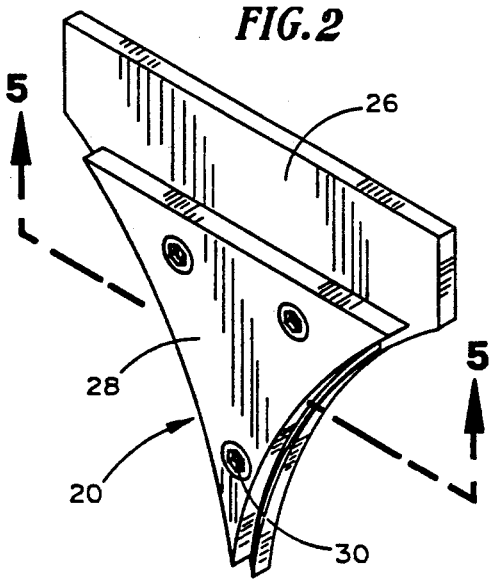
FIG. 2 is a perspective view of the cheek plate.
Figure 3:
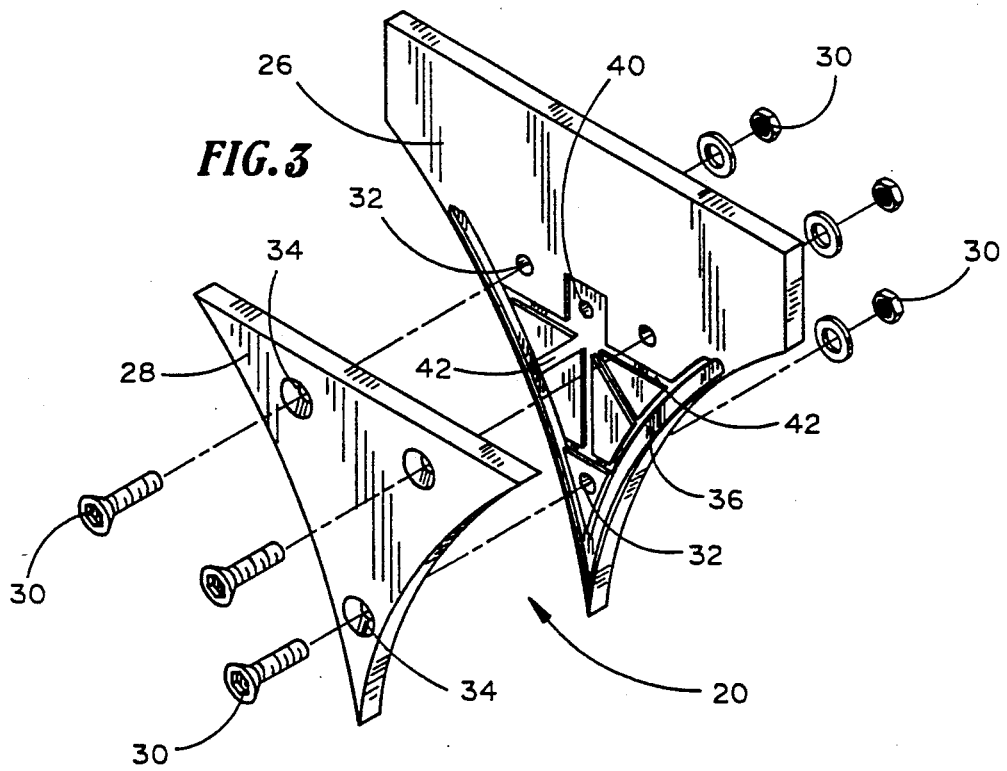
FIG. 3 is an exploded perspective view of the cheek plate showing a face plate and a base plate thereof.

The cheek plate 20, as best illustrated in FIGS. 2 and 3, includes a base plate 26 and a face plate 28 that are releasably interconnected to form a body member by a plurality of nut and bolt assemblies 30 inserted in corresponding aligned openings 32 and 34 of the base plate 26 and face plate 28, respectively. The heads of the bolt assemblies 30 fit flush with the top surface of the face plate 28. The base plate 26 and the face plate 28 are each of a cuneiform or a generally arrowhead shape having two concave edges symmetric about the longitudinal center line thereof.

Figure 4:
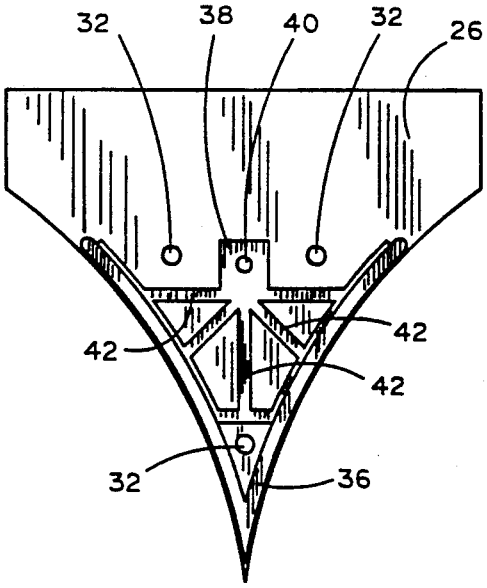
FIG. 4 is a front view of the base plate.

A plurality of channels are formed in the base plate 26 (FIGS. 3 and 4). The channels include an edge channel 36 that forms a depression in the base plate 26 near the concave edges thereof and of a generally arrowhead shape conforming to the contour of the base plate 26. A central inlet chamber 38 is located intermediate the two side portions of the edge channel 36 and on the longitudinal center line of the base plate 26. A compressed air inlet 40 communicates from the opposite side of the base plate 26 and into the inlet chamber 38. A plurality of feed channels 42 are arranged generally radially of the inlet chamber 38 and are in communication with the inlet chamber 38 and the edge channel 36 at a number of regularly spaced locations.

Figure 5:
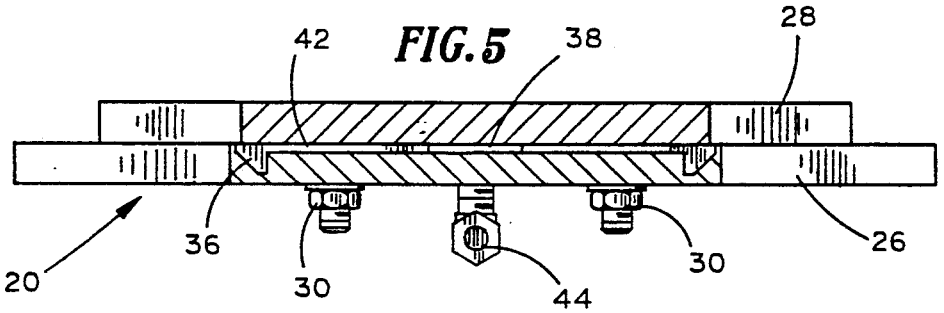
FIG. 5 is a top plan view of the cheek plate taken along line 5—5 of FIG. 2.

When the face plate 28 is attached to the base plate 26, the inlet chamber 38, feed channels 42, and inner portions of the edge channel 36 are covered from above by the face plate 26. As best illustrated in FIGS. 2 and 5, the concave edges of the face plate 28 are spaced inwardly of the concave edges of the base plate 26 by a regular distance. Accordingly, the outer portion of the edge channel 36 is open to the atmosphere along the concave edges of the face plate 28. Compressed air present at the inlet opening 40 by way of fitting 44 will thus flow into the inlet chamber 38, through the feed channels 42 to the edge channel 36 and out to the atmosphere along the concave edges of the face plate 28.

Figure 6:
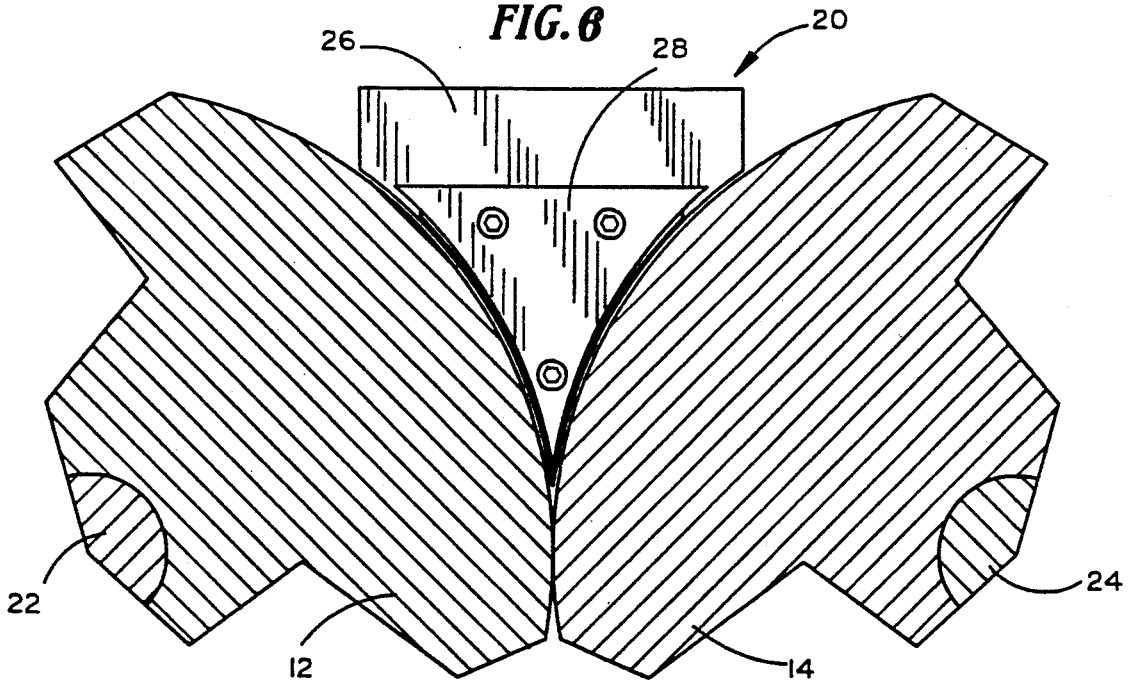
FIG. 6 is a front view of the cheek plate mounted closely adjacent to the rollers of the milling apparatus.

The assembled cheek plate 20 is positioned near the rollers 12 and 14, as illustrated in FIGS. 1 and 6, such that the concave edges of the base plate 26 are spaced evenly a small distance from the periphery of the rollers 12 and 14, having a radius of curvature slightly larger than the radius of the rollers. Compressed air is supplied through the fitting 44 (FIG. 5). As described above, the compressed air escapes from the cheek plate 20 along the concave edges thereof in a direction generally inwardly from the end plate 16. The compressed air will act to blow material being milled out of the area near the cheek plate 20 thereby preventing its escape past the ends of the rollers and ensuring that it is milled. Because the cheek plate 20 is not in contact with the rollers 12 and 14, there is no wear or abrasion during operation so that the cheek plate 20 will only infrequently require adjustment or replacement.

I claim:

1. A cheek plate for a milling apparatus which includes a supply of compressed gas and having a pair of milling rollers, comprising:

(a) a base plate of generally cuneiform shape having a pair of concave edges for mounting adjacent and having a radius of curvature generally conforming to the milling rollers;

(b) a face plate of a generally cuneiform shape having a pair of concave edges and releasably attachable to said base plate; and (c) channel means including edge channels formed in said base plate along said concave edges for distributing said compressed gas for release to the atmosphere along said concave edges of said face and base plates and adjacent the milling rollers.

2. A check plate for a milling apparatus which includes a supply of compressed gas and having a pair of milling rollers, comprising:

(a) a body member of a generally cuneiform shape having a pair of concave edges for mounting adjacent and having a radius of curvature generally conforming to the milling rollers; and (b) channel means in said body member including edge channels formed in said body member along said concave edges and for distributing said compressed gas for release to the atmosphere along said concave edges.

3. The cheek plate as defined in claim 1, wherein said face plate, upon attachment thereof to said base plate, overlies substantially all of said edge channels except for a narrow portion adjacent said concave edge of said base plate.

4. A milling apparatus including a supply of compressed gas and a pair of milling rollers, comprising:

(a) a cheek plate including a body member of generally cuneiform shape having a pair of concave edges with a radius of curvature generally conforming to the milling rollers;

(b) said cheek plate is mounted adjacent to the milling rollers wherein said concave edges are spaced a generally uniform distance from the milling rollers;

(c) edge channels formed in said body member along said concave edges for distributing said compressed gas for release to the atmosphere along said concave edges.

* * * * *